United States Patent [19]

Sugita et al.

[11] Patent Number: 4,708,598

[45] Date of Patent: Nov. 24, 1987

[54] ROTARY TYPE GAS COMPRESSOR

[75] Inventors: Terumitsu Sugita; Hideo Shinozuka, both of Narashino; Koji Murayama, Tatebayashi, all of Japan

[73] Assignees: Seiko Seiki Kabushiki Kaisha; Nihon Radiator Co., Ltd., both of Japan

[21] Appl. No.: 630,599

[22] Filed: Jul. 13, 1984

[51] Int. Cl.[4] ..... F04B 49/00; F04C 18/344; F04C 29/08

[52] U.S. Cl. ..... 417/295; 417/300; 418/15

[58] Field of Search ..... 417/295, 289, 293, 300, 417/302; 418/15, 259

[56] References Cited

U.S. PATENT DOCUMENTS

| | | | |
|---|---|---|---|
| 1,616,992 | 2/1927 | Ruckstuhl | 417/295 X |
| 2,741,424 | 4/1956 | Ploeger | 417/295 X |
| 3,671,148 | 6/1972 | Reeve | 417/295 |
| 4,480,962 | 11/1984 | Niemiec | 417/300 X |

FOREIGN PATENT DOCUMENTS

| | | | |
|---|---|---|---|
| 76256 | 4/1919 | Austria | 417/295 |
| 3220033 | 12/1982 | Fed. Rep. of Germany | 418/259 |
| 57-91394 | 6/1982 | Japan | 417/295 |
| 57-126593 | 8/1982 | Japan | 417/295 |
| 58-65995 | 4/1983 | Japan | 418/15 |
| 133890 | 9/1929 | Switzerland | 418/15 |

*Primary Examiner*—John J. Vrablik

*Attorney, Agent, or Firm*—Bruce L. Adams; Van C. Wilks

[57] ABSTRACT

A rotary vane-type gas compressor for use in car coolers and the like has a plurality of intake ports for each compression working chamber located at positions shifted from one another in the revolving direction of a rotor. At least one intake port which is located at the most forward position in the revolving direction of the rotor has a throttle valve which is controlled in response to the flow rate of suctioned gas, and the opening degree of the throttle valve is changed as the revolution speed of the rotor increases and creates a higher flow rate of suctioned gas. This reduces the effective compression working chamber volume, i.e., the volume which results when one vane has passed the position of the corresponding intake port to enclose gas in the compression working chamber. By such a construction, it is possible to restrain a substantial increase in both the amount of compressed gas to be discharged and the air-cooling capacity, even when the revolution speed of the rotor increases above 2000 rpm.

11 Claims, 6 Drawing Figures

ROTARY TYPE GAS COMPRESSOR

BACKGROUND OF THE INVENTION

This invention relates to an improvement in compressors for use in car coolers, etc.

A gas compressor adapted to be used in air cooling for passenger cars, etc. is usually juxtaposed with an engine of the motor vehicle to be driven by a crank shaft pulley of the engine through a V-belt, and a solenoid clutch provided on the compressor side serves to make connection with or disconnection from the driving side (i.e., the engine).

Accordingly, the refrigerating capacity of such a gas compressor is enhanced substantially in proportion to the engine speed. Long time driving of the engine causes over-refrigeration of the car interior because the gas compressor is driven also at high speeds. In addition, power consumption by the compressor is increased and the temperature of the discharged gas is raised up correspondingly. This disadvantageous tendency is particularly remarkable in a rotary type gas compressor because compressors of this type have no intake valve and have a lesser amount of residual compressed gas in the working chambers of the compressor thereby resulting in an increased volumetric efficiency during high-speed driving.

To prevent such excessive air cooling, there has been proposed a technique, for example, in which the solenoid clutch is engaged or disengaged in response to an output from a temperature sensor provided on an evaporator or on some other part so as to operate the gas compressor under ON/OFF control.

However, this technique has the drawback that the solenoid clutch is subject to substantial wear because of its repeated engagement and disengagement and load fluctuations of the engine are enlarged.

There has been also proposed a technique in which a throttle valve is provided in a flow passage in communication with an intake port to narrow the opening area during high-speed rotation so that the intake loss is enlarged to restrict an increase in the compression capability. But this method is disadvantageous since it results in an increased engine load.

SUMMARY OF THE INVENTION

It is an object of this invention to automatically restrict an increase in both the air-cooling capacity and the power consumption during a range of driving under high-speed revolution, and to prevent a rise in the temperature of the discharged gas, by making a simple modification to a conventional gas compressor.

To achieve the above object, this invention comprises a rotary type gas compressor having one or more compression working chambers formed between a cylinder and a rotor rotatably held in the cylinder, a plurality of intake ports for supplying gas to each of the compression working chambers, and a discharge port for discharging the gas compressed in each compression working chamber to the outside. The plurality of intake ports are disposed at positions shifted from one another corresponding to different angular positions of the rotor. A throttle valve is provided in a flow passage in communication with at least one intake port located at a position corresponding to the most forward angular position of the rotor, and an actuator of the throttle valve is disposed to change the degree of opening of the throttle valve as the flow rate of gas suctioned due to revolution of the rotor is increased. With this arrangement, as the revolution speed of the rotor becomes higher, an enclosing angle position of the compression working chamber is changed to reduce the enclosed gas volume, to thereby restrain an increase in the amount of discharged gas, resultant excessive air-cooling capacity as well as a rise in temperature of the discharged gas, even when the revolution speed of the rotor is much increased. According to this invention, since the position of the effective intake port is shifted in accordance with the opening and closing of the throttle valve instead of throttling the whole of the intake ports, an increase in driving power can be also restrained even under higher revolution speed of the rotor.

BRIEF DESCRIPTION OF THE DRAWINGS

The drawings illustrate a gas compressor according to one embodiment of this invention in which.

DETAILED DESCRIPTION OF PREFERRED EMBODIMENT

Figure 1:
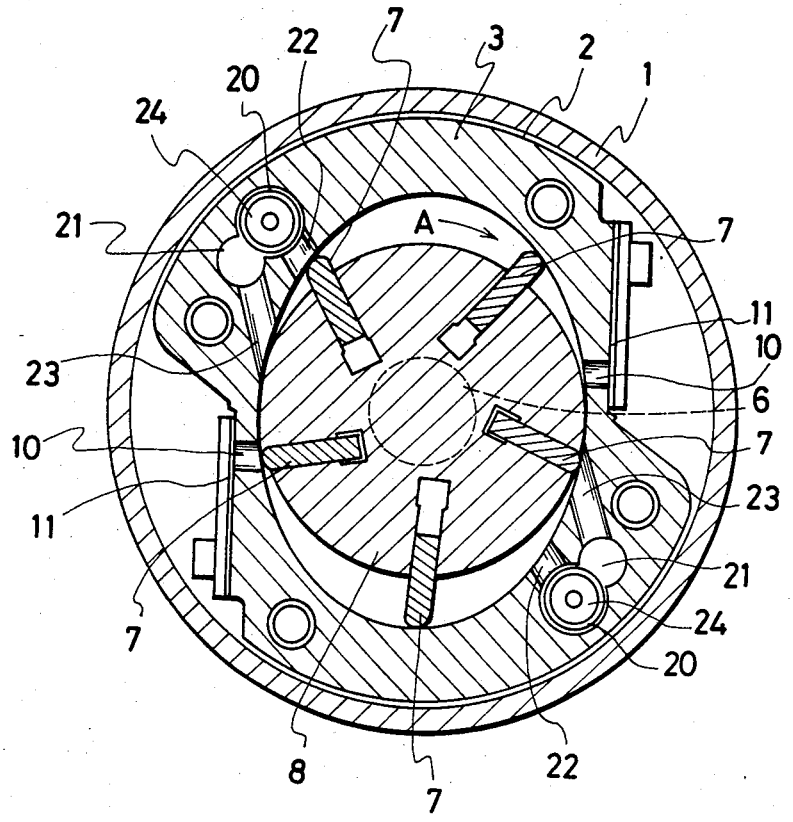
FIG. 1 is a front sectional view of the gas compressor.
Figure 2:
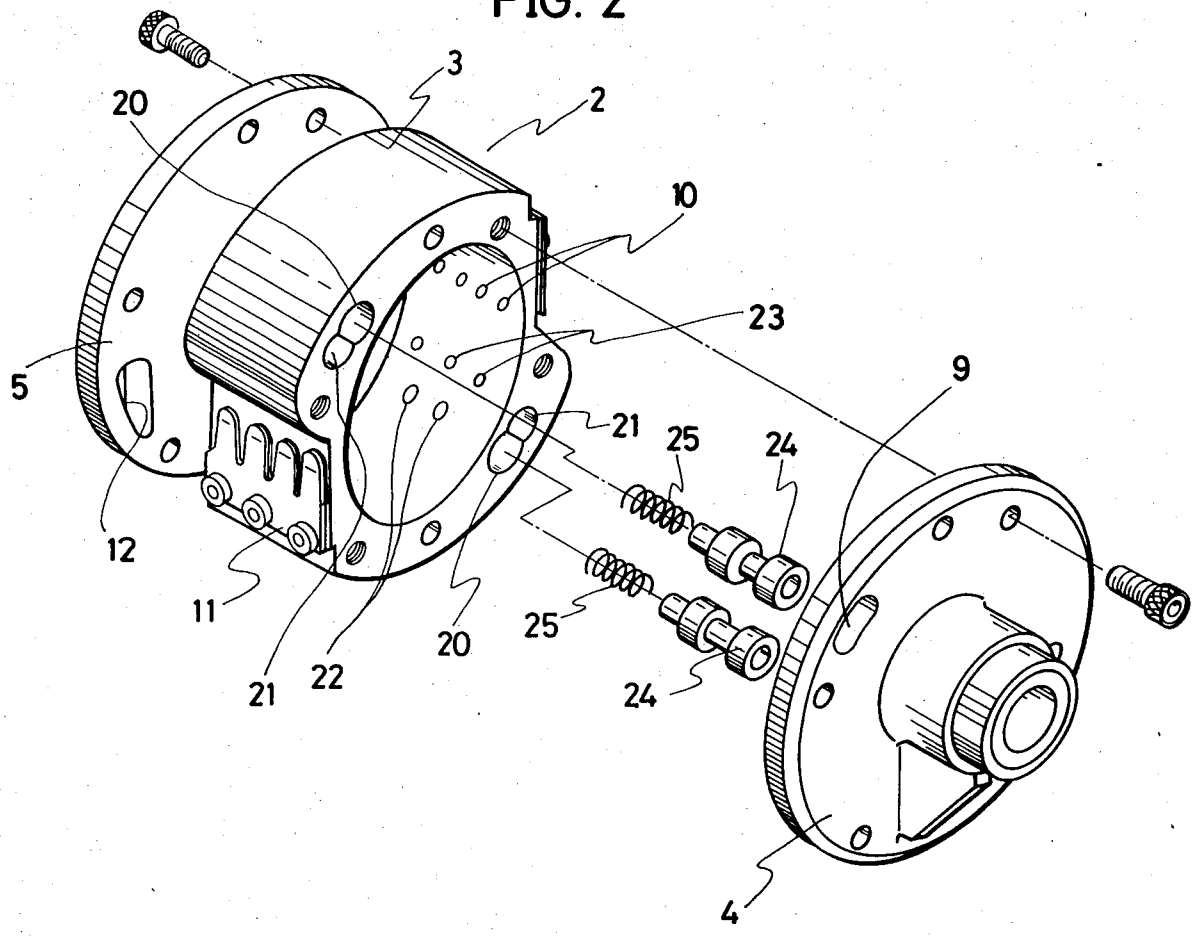
FIG. 2 is an exploded perspective view of a main part of the gas compressor with the rotor removed for clarity.

A gas compressor shown in the drawings includes a compressor body 2 housed in the inside of a cylindrical casing 1. The compressor body 2 comprises a cylinder 3 having a cylindroidal inner periphery which defines the cylinder chamber, a front side block 4 and a rear side block 5, these blocks being mounted on both sides of the cylinder 3. A solid cylindrical rotor 8 is horizontally rotatably mounted in a cylindroidal cylinder chamber defined by the three members 3, 4 and 5. The rotor 8 is integral with a rotor shaft 6 and has five vanes 7 slidably disposed in radial grooves or slots which are formed in the rotor. The rotor 8 divides the cylinder chamber into two sub-chambers (compression working chambers), and the five vanes 7 coact with the rotor and cylinder chamber to define expansible working chambers between each two adjoining vanes for receiving, compressing and discharging gas.

The rotor shaft 6 projects through the front side block 4 and the leading end of the casing 1, and is adapted to be coupled to a crank shaft pulley of an engine through a solenoid clutch (not shown). When rotation of the rotor shaft 6 drives the rotor 8 to revolve in the direction of an arrow A, low pressure gas is introduced from an intake opening formed in the front part of the casing 1 and then suctioned into the cylinder chamber from flow holes 9 formed in the front side block 4 through later-described flow passages and intake ports formed in the cylinder 3 so as to be compressed.

On the other hand, high pressure gas having been compressed in the cylinder chamber is discharged into a gap between the outer periphery of the cylinder 3 and the inner periphery of the casing 1 through discharge ports 10 and reed valves 11 for preventing a backward flow, and the compressed gas is then exhausted to the outside from a discharge opening formed in the rear part of the casing 2 through flow holes 12 formed in the rear side block 5.

Hereinafter there will be described in detail the construction of the flow passages and the intake ports which are essential parts of this invention.

The flow passages consist of a pair of main flow passages 20 which extend axially of the cylinder 3, and a pair of auxiliary or sub-flow passages 21 of smaller diameter which likewise extend axially of the cylinder 3 in a contiguous relation with respect to the respective main flow passages 20. Each paired main flow passage 20 and sub-flow passage 21 has a gourd-like cross section as a whole and is connected to the flow hole 9 formed in the front side block 4.

Each of the main flow passages 20 communicates with a pair of main intake ports 22 radially extending through the cylinder 3, while each of the sub-flow passages 21 communicates with three auxiliary or sub-intake ports 23 also radially extending through the cylinder 3.

Further, each main flow passage 20 includes a slidable spool or actuator 24 and a biasing spring 25 fitted therein to normally urge the spool 24 toward the gas inlet port side (i.e., the flow hole 9 side), thus constituting a throttle valve mechanism which functions to gradually throttle the main intake ports as the flow rate of gas suctioned into the cylinder chamber increases.

The main intake ports 22 are arranged to open at such a position that the enclosed gas volume of the compression working chamber defined between one vane and the preceding vane, when the former has passed the position of the main intake ports, becomes substantially maximum, for better efficiency. On the other hand, the sub-intake ports 23 are arranged to open at a position shifted toward the backward side with regard to the rotational angle of the rotor 8 relative to the position of the main intake ports 22.

In this embodiment, since five vanes are used to divide the inside of the cylinder chamber into five expansible working chambers, the main intake ports 22 are formed at a position offset from the short-diametric plane of the cylinder chamber by about 54 degrees toward the forward side in the rotating direction of the rotor 8, while the sub-intake ports 23 open at a position offset from the position of the main intake ports 23 by 20 to 30 degrees in the backward direction.

In this embodiment, therefore, assuming that the maximum enclosed gas volume defined by a pair of adjacent vanes 7 when the succeeding one of them has passed the main intake ports 22 is 100%, the enclosed gas volume defined by these two vanes 7 when the succeeding one has passed the sub-intake ports 23 becomes about 17% smaller than the maximum enclosed gas volume.

Figure 3A:
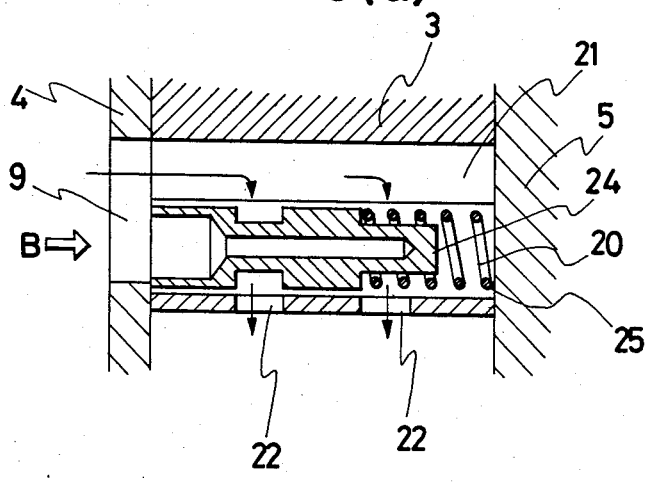
FIGS. 3(*a*) and 3(*b*) are schematic sectional views showing a part of FIG. 2 on an enlarged scale.
Figure 3B:
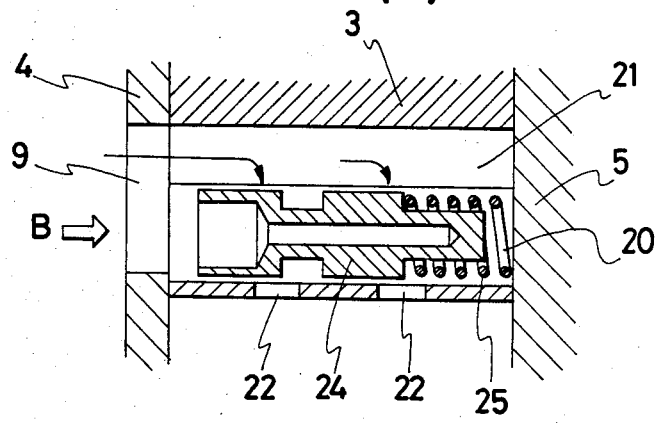

As shown in FIGS. 3(*a*) and 3(*b*), the spool 24 is prevented from projecting out of the cylinder 3 by abutting against the inner wall of the front side block 4, and offers the maximum opening degree of the main intake ports 22 (referred to as "valve opening degree" hereinafter) when it takes such an abutment position. The spool 24 can be displaced in the direction of an arrow B under the pushing action of the gas that is introduced from the flow hole 9 and suctioned into the cylinder chamber. When the revolution speed of the rotor 8 increases, the amount of gas suctioned into the cylinder chamber per unit time is increased, and the flow rate of gas flowing into the respective flow passages 20, 21 is increased, whereby the pushing force against the spring force of the spring 25 increases to displace the spool 24 so as to reduce the valve opening degree of the main intake port 22.

In this way, when the spool 24 abuts against the inner wall of the front side block 4 by the resilient force of the spring 25 as shown in FIG. 3(*a*), the valve opening degree is maximum and gas introduced from the flow hole 9 is distributed to the sub-intake ports 23 and the main intake ports 22 through the sub-flow passage 21 to enter the cylinder chamber, so that the compression is effected with a condition exhibiting the maximum enclosed gas volume of 100%.

On the other hand, when the spool 24 is displaced in the direction of the arrow B as shown in FIG. 3(*b*), the valve opening degree becomes smaller and the flow rate of gas through the main intake ports 22 is reduced, which causes gas quantity or mass reduction at the maximum enclosing position. Finally, the valve opening degree becomes nearly zero when the spool 24 is displaced to its end position, so that gas is now introduced only through the sub-intake ports 23 and the resultant enclosed gas volume is reduced.

Stated differently, when the rotor 8 is revolved at a low speed the intake of gas is completed at the regular enclosing position, whereby the gas compressor can be maintained in a high efficiency state. On the other hand, since the enclosing is completed at the position of the sub-intake ports 23 or, if not so, the valve opening degree of the main intake ports 22 becomes very small during revolution of the rotor 8 at a high speed, the effective enclosed gas volume or gas quantity is reduced so that the amount of discharged gas is decreased and this results in reduction of both air-cooling or refrigerating capacity and driving power.

Figure 4A:
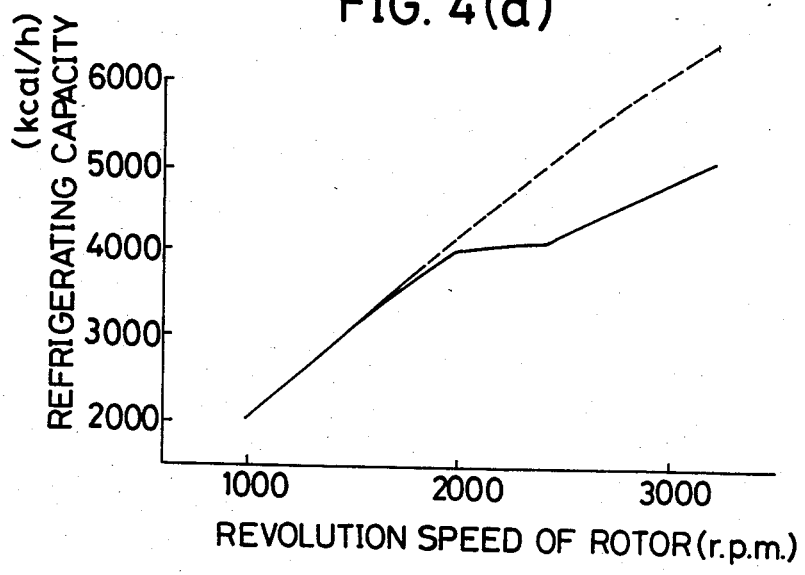
FIGS. 4(*a*) and 4(*b*) are characteristic graphs showing the operating effects of this invention.
Figure 4B:
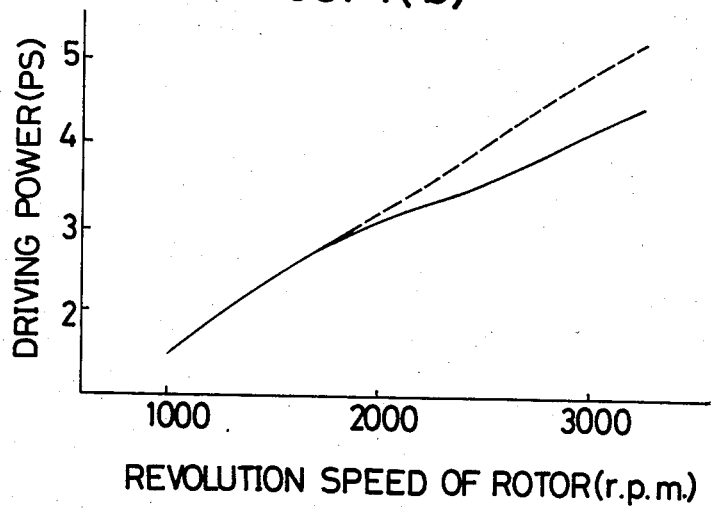

FIGS. 4(*a*) and 4(*b*) are graphs showing measured data of driving power (power consumption) and air cooling capacity both versus revolution speed of the rotor, in which the solid lines correspond to a gas compressor constructed according to this invention and the dotted lines correspond to a conventional gas compressor having similar specifications to the former but having main intake ports of constant opening degree.

It is seen from the graphs that when the revolution speed of the rotor of the gas compressor embodying this invention is increased and then exceeds about 2000 rpm, i.e., enters a range of high revolution speed, both driving power and air cooling capacity are automatically restrained in their increasing rates as compared to the conventional gas compressor.

In the gas compressor of the above embodiment, the throttle valve can be operated with less power under the action of the intake gas flow by such a simple construction that a spool normally urged in one direction by a spring is used as an actuator of the throttle valve, and a flow passage in communication with the other group of intake ports is provided in parallel to the spool in a contiguous relation therewith. Further, it is so arranged that the volume of the compression working chamber enclosed at the vane passing position over one group of intake ports which has the throttle valve, is larger than that enclosed at the vane passing position over another group or groups of intake ports which have no throttle valve and are shifted from the throttle valve-provided ports toward the backward direction with respect to the rotating direction of the rotor. This arrangement is advantageous from the standpoint of less loss under compression as compared with the reverse arrangement (in which the forward-side located and throttle valve-provided ports correspond to the smaller volume of the compression working chamber and the throttle valve is gradually opened as the revolution speed of the rotor is increased).

We claim:

1. In a rotary vane-type gas compressor having a cylinder defining a cylinder chamber, a rotor mounted to undergo rotation within the cylinder chamber and rotationally driven at varying speeds during use of the compressor, a plurality of slidable vanes slidably disposed in radial slots formed in the rotor such that the radial outer ends of the vanes make sliding contact with the cylinder chamber wall during rotation of the rotor, the vanes coacting with the rotor and cylinder chamber to define expansible working chambers between each two adjoining vanes for compressing gas in response to rotation of the rotor: gas admitting means for admitting gas to be compressed into the working chambers at a flow rate proportional to the speed of rotation of the rotor; gas discharging means for discharging compressed gas from the working chambers; and throttling means for throttling the flow of gas admitted into the working chambers in accordance with the flow rate of gas so as to reduce the mass of gas admitted into the working chambers during higher speeds of rotation of the rotor.

2. A rotary vane-type gas compressor according to claim 1; wherein the throttling means comprises a flow-responsive throttle valve responsive to the flow rate of gas flowing into the working chambers.

3. A rotary vane-type gas compressor according to claim 1; wherein the gas admitting means comprises main intake ports formed in the cylinder and opening into the cylinder chamber for admitting gas into the working chambers, auxiliary intake ports formed in the cylinder and opening into the cylinder chamber for admitting gas into the working chambers, and passage means for flowing gas to be compressed to the main and auxiliary intake ports; and the throttling means comprises flow-responsive throttle valve means disposed in the passage means and responsive to the flow rate of gas flowing therethrough for throttling the flow of gas through the main intake ports.

4. A rotary vane-type gas compressor according to claim 3; wherein the main intake ports open into the cylinder chamber at locations which are angularly ahead of the locations of the auxiliary intake ports with respect to the direction of rotation of the rotor.

5. A rotary vane-type gas compressor according to claim 4; wherein the cylinder chamber has an oblong cross section and the rotor has a circular cross section, the diameter of the rotor being equal to the minor diameter of the cylinder chamber thereby dividing the cylinder chamber into two sub-chambers, and the plurality of vanes comprise five vanes disposed equidistantly about the rotor so as to define jointly with the rotor and cylinder chamber five working chambers.

6. A rotary vane-type gas compressor according to claim 5; wherein the main and auxiliary intake ports for admitting gas into the working chambers are disposed in axial rows, each row of main intake ports being located 20°–30° ahead of a row of auxiliary intake ports with respect to the direction of rotation of the rotor.

7. A rotary vane-type gas compressor according to claim 4; wherein the main and auxiliary intake ports for admitting gas into the working chambers are disposed in axial rows with each row of main intake ports being located ahead of a row of auxiliary intake ports with respect to the direction of rotation of the rotor.

8. A rotary vane-type gas compressor according to claim 4; wherein the flow-responsive throttle valve means includes means for completely blocking gas flow through the main intake ports when the flow rate of gas increases to a certain value whereupon gas is admitted into the working chambers only through the auxiliary intake ports.

9. A rotary van-type gas compressor according to claim 3; wherein the flow-responsive throttle valve means includes means for completely blocking gas flow through the main intake ports when the flow rate of gas increases to a certain value whereupon gas is admitted into the working chambers only through the auxiliary intake ports.

10. In a rotary type gas compressor comprising one or more compression working cahmbers formed between a cylinder and a rotor rotatably held in said cylinder, vanes slidably disposed in radial slots formed in said rotor, intake ports for supplying gas to each of said compression working chambers, and a discharge port for discharging gas compressed in each said compression working chamber to the outside, the improvement wherein the plurality of intake ports are disposed at positions shifted from one another corresponding to different angular positions of said rotor, and a throttle valve disposed in a flow passage in communication with at least one intake port which is located at a position corresponding to the most forward angular position of said rotor, said throttle valve having an actuator responsive to the flow rate of gas, which results from the revolution of said rotor, to change the opening degree of said throttle valve so that as the revolution speed of said rotor becomes higher, the mass of gas admitted to said compression working chamber is reduced.

11. A rotary type gas compressor according to claim 10, wherein the actuator of said throttle valve comprises a spool normally urged in one direction by means of a spring, and a flow passage communicating with another intake port disposed parallel to said spool in a contiguous relation therewith.

* * * * *